United States Patent [19]

Cameron

[11] 4,425,962

[45] Jan. 17, 1984

[54] HEATING APPARATUS

[75] Inventor: William M. Cameron, Wellington, New Zealand

[73] Assignee: Macewans Machinery Limited, Wellington, New Zealand

[21] Appl. No.: 349,601

[22] Filed: Feb. 17, 1982

[51] Int. Cl.[3] ..... B01F 15/06

[52] U.S. Cl. ..... 165/92; 99/348; 366/147

[58] Field of Search ..... 99/348; 366/144, 147, 366/325; 165/92, 85, 109 R, 120

[56] References Cited

U.S. PATENT DOCUMENTS

| | | | |
|---|---|---|---|
| 2,540,250 | 2/1951 | Feldstein | 165/92 |
| 2,753158 | 7/1956 | Rebechini | 366/325 |
| 3,020,025 | 2/1962 | O'Mara | 366/147 |
| 3,281,124 | 10/1966 | Pawlowski | 366/325 |
| 3,739,710 | 6/1973 | Costa | 99/348 |

*Primary Examiner*—Robert W. Jenkins

*Attorney, Agent, or Firm*—Scully, Scott, Murphy & Presser

[57] ABSTRACT

A steam heated beatershaft for use in a cooking chamber is shown in FIG. 1 having at its drive end a driven shaft (2) and at its opposite end a hollow shaft (4) which in use is connected to a steam supply whereby steam can be fed from a concentric steam chamber and respective hollow support arms into respective annular hollow rings (9). A collecting tube extends from each hollow ring through a respective hollow arm into a collection chamber mounted concentrically within the steam chamber so that as the rings (9) rotate in heating and agitating the material in the cooking chamber condensate within the hollow rings (9) is collected and transfered from the collection chamber through a discharge tube provide through the hollow shaft (4).

17 Claims, 5 Drawing Figures

HEATING APPARATUS

This invention relates to heating apparatus and more particularly to heating apparatus which is adapted to simultaneously agitate or stir the material being heated.

While the present invention will be hereinafter described particularly with reference to a steam heated beatershaft for use in the cooking vessel of a meat processing plant it is to be understood that such use is given by way of example and not by limitation.

In previous designs of steam heated beatershafts for use in cooking chambers it has been known to provide steam flow along elongate tubes or hollow beaters running co-axially relative to and rotating with a rotating shaft, the tubes or beaters in their rotation stirring the material being cooked as well as imparting heat thereto conducted through the tube walls. The beatershaft would normally be mounted within a vessel having a steam jacket positioned therearound and forming the external walls of the cooking vessel.

It is an object of a preferred embodiment of the present invention to provide a steam heated beatershaft which provides more efficient heating of material within a cooking vessel in which the beatershaft is mounted, which enables the separation of steam and condensate, which facilitates the efficient removal of condensate and air, and which at the same time offers less resistance to rotation thus consuming less power than previous designs.

Further objects of the invention will become apparent from the following description.

Accordingly, one embodiment of the present invention provides a steam heated beatershaft comprising:

(a) steam inlet means connected with an outer steam chamber, (b) outlet means to remove condensate and air connected with an inner co-axial collecting chamber, (c) a plurality of spaced apart annular hollow rings mounted about and in steam connection with said steam chamber and (d) condensate and air removal means providing a flow connection between each ring and said collecting chamber.

Figure 1:
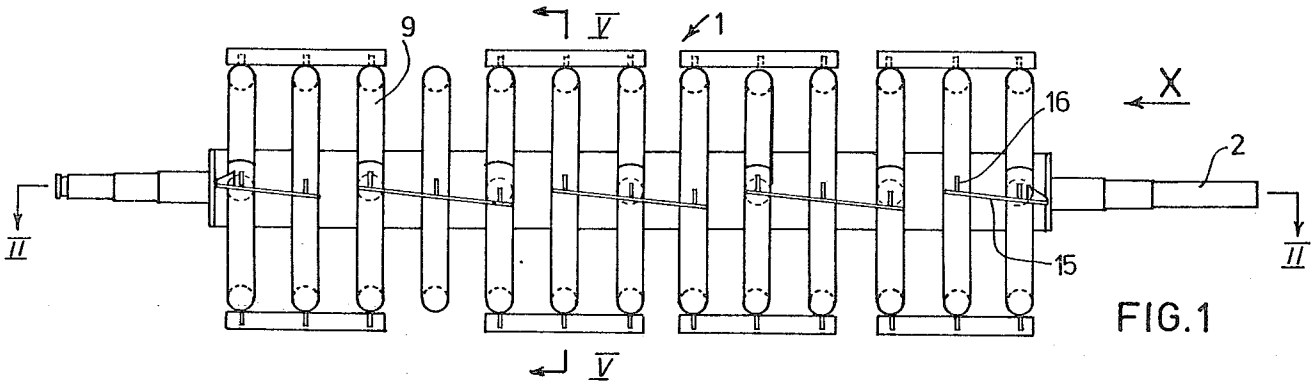

One embodiment of the present invention will now be described by way of example and with reference to the accompanying drawings wherein:

FIG. 1: shows a side elevational view of a steam heated beatershaft according to one embodiment of the invention.

Figure 2:
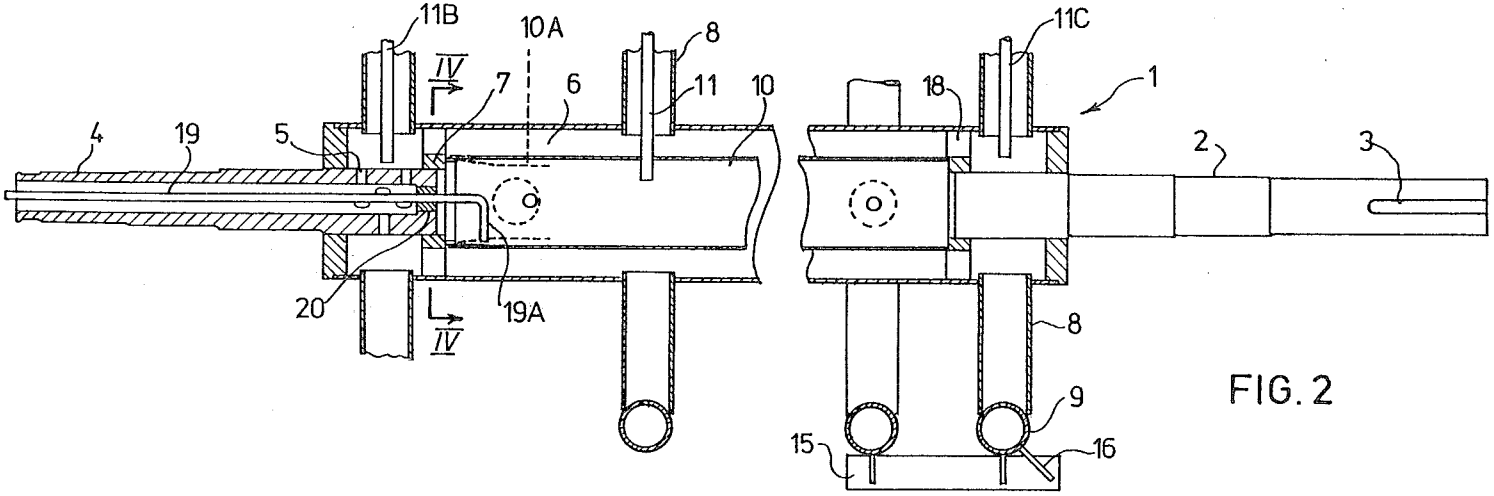

FIG. 2: shows a part sectional view along arrows II—II of FIG. 1

Figure 3:
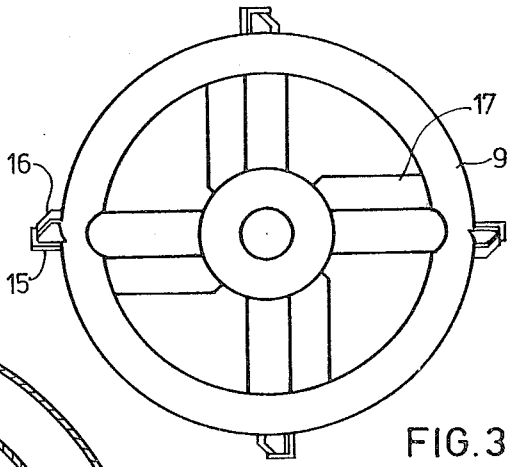

FIG. 3: shows an end elevational view in a direction of arrow X of FIG. 1

Figure 4:
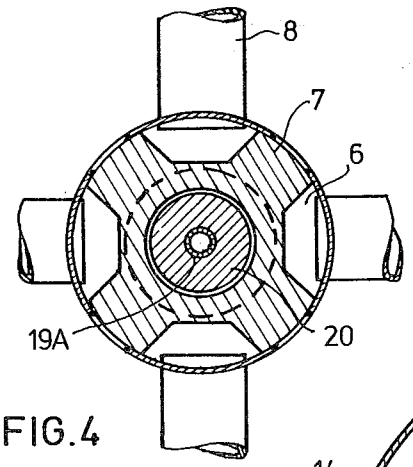

FIG. 4: shows a cross sectional view along arrows IV—IV of FIG. 2

Figure 5:
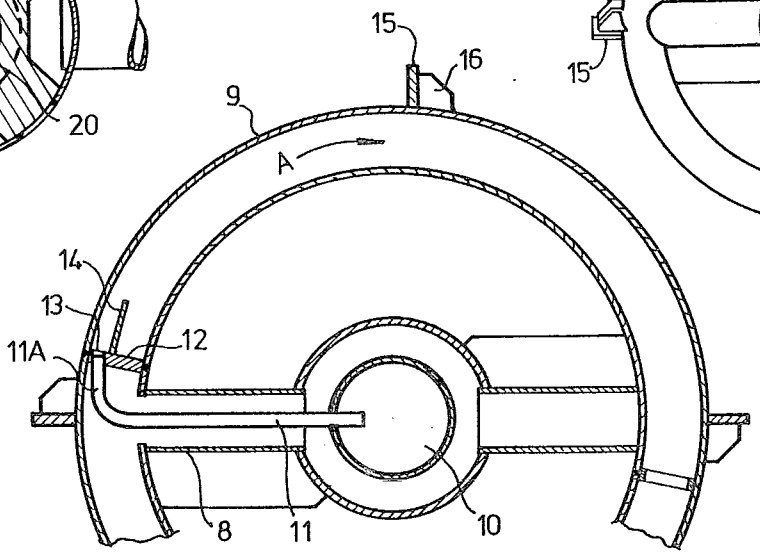

FIG. 5: shows a part sectional view along arrows V—V of FIG. 1

The present invention can be broadly said to reside in a steam beatershaft having co-axial but separated steam and condensate collecting chambers. A plurality of hollow rings are spaced apart along the length of the steam chamber to receive steam therefrom and have condensate collecting tubes collecting the condensate formed within the annular rings and taking it to the condensate collecting chamber for subsequent removal from the beatershaft. Any air or non-condensable gas which gains entry or enters with the steam is also collected and taken to the collecting chamber for subsequent removal with the condensate.

It has been found that by the use of a plurality of steam receiving spaced apart annular rings in the manner above mentioned a particularly efficient steam heating and beating operation is effected on the material within a cooking chamber in which the beatershaft is mounted to such an extent that it is envisaged that the normally provided outer steam jacket could be dispensed with. It is believed that this efficiency of heating is due both to the large heating surface provided by the plurality of steam heated rings together with the characteristics of steam and condensate flow and their separation in the beatershaft and the efficient removal of air or gas which when present inhibits efficient heat exchange.

Reference will now be made to the accompanying drawings where one embodiment of the invention is shown by way of example and is referenced generally by arrow 1.

The beatershaft 1 has at its drive end a shaft 2 with keyway 3 and at its front end a hollow shaft 4. The shaft 4 in use will be connected to a steam supply whereby steam passing through steam inlets 5 will be fed to a steam chamber 6 past a spider 7 and hence through hollow arms 8 to a respective annular hollow ring 9.

Co-axially mounted within the steam chamber 6 is a collection chamber 10 connected to each annular ring 9 via collecting tubes 11 passing through a respective arm 8.

The arms 8 assist in agitation and heating and in the latter regard particularly contribute to the heat exchange adjacent to and in conjunction with the surface of the chamber 10.

The outer end 11A of each tube 11 is bent over and extends into an opening 13 associated with a support 12 and a guide 14 whereby as the ring 9 rotates in the direction indicated by arrow A condensate formed therein is caused to travel by centrifugal force along the inside of the exterior wall of the ring 9 and is then guided by the guide plate 14 into the opening 13 and via the tube 11 for collection along with air or non-condensable gas in the chamber 10.

In previous designs of beatershafts the centrifugal force due to rotation of the beatershaft has tended to prevent the efficient collection of condensate as the centrifugal force tended to counteract the falling of the condensate under gravity to enable it to be collected. However by utilizing the collecting tube 11 the condensate is in fact scooped up as the ring 9 rotates so that the centrifugal force tending to hold the condensate against the exterior wall of the ring 9 is in fact utilized in providing for an efficient collection of the condensate. The hydrostatic head along the length of the tube 11 results in the condensate so collected being transferred efficiently along the tube 11 into the collecting chamber 10 along with any entrained air or non-condensable gas.

Two support arms 8 only may be fitted to each annular ring 9 as shown in FIG. 5 in which case the arms in alternate ring assemblies may be at 90° to each other so as to facilitate free flow of material therethrough while at the same time promoting agitation of material.

Alternatively a plurality of support arms 8 may be fitted to each annular ring 9 with the arms 8 in alternate ring assemblies at a suitable angle to each other to facilitate free flow and to promote agitation of material.

In all cases the positioning of the support arms 8 and sets of blades 15 are such as to ensure the rigidity of the resulting structure. The blades 15 are seen mounted by means of gussets 16 on respective rings 9 with the blades 15 in use agitating the material and may be angled to also facilitate the movement e.g. the forward feeding of the material and the resisting of any backward movement, these functions additionally being achievable by the positioning of the gussets 16.

Ring support members 17 also serve to control the movement of the material relative to the rings 9.

The desired movement of material relative to the beatershaft 1 will depend on the type of cooking or drying operation being effected. Thus in a batch system the material will be loaded in at one or more points and discharged after cooking/drying. To achieve the desired discharge patterns the blading 15 could be suitably angled and if discharge at two separate points was required for example the blading 15 could be set at different angles to enable this to take place.

In some systems the beatershaft 1 could be rotated in one direction for cooking or drying and then counter rotated for discharge to take place and again the blading 15 would be required to accommodate this.

In a continuous system the material is loaded in at a particular point and withdrawn again at a different point. The blades 15 in such case are disposed to promote the desired movement of the material relative to the beatershaft 1 and/or reliance can be placed on displacement of the material i.e. movement which relies on material filling up the space left by the material that has been discharged.

While a plurality of separate rings 9 are shown it is envisaged that in an alternative embodiment a spiral tube or spiral segments could instead be utilized.

Again, in order to facilitate flow of condensate through the condensate chamber 10 the walls of the chamber 10 may it is envisaged be tapered as indicated in outline in FIG. 2 and referenced 10A. In this case the taper of the condensate chamber 10 would promote the flow of condensate towards the wider end.

To allow for relative thermal expansion of the chamber 10 its front end adjacent the front spider 7 will generally be free to slide, the rear chamber walls adjacent a rear spider 18 generally being fixed or vice versa. A condensate collecting and air removal tube 19 is shown extending through the shaft 4 and having an inner end 19A extending through and secured to a blanking bush 20 which is a close clearance in a hole at the inner end of shaft 4 whereby as the chamber 10 rotates condensate and air collected therein then passes down the tube end 19A for removal.

As an alternative to further facilitate the separation of steam and condensate flows it is possible to arrange that steam alone be introduced through a hollow shaft at one end with condensate and air removed via a collecting tube introduced through a hollow shaft at the opposite end.

It is desirable that as far as possible air is kept out of the system and when the shaft is first put into operation after being idle that the air within the system is displaced as speedily as possible.

It has been found that with the provision of the steam and condensate flow paths such as in the embodiment of the invention above described a positive circulation of the steam and sweeping out of the air together with the elimination of condensate is achieved.

It is mentioned that whilst the two outermost condensate collecting tubes 11B and 11C are not directly coupled to the collecting chamber 10, condensate exiting from those particular tubes will in fact be collected with the condensate of the next adjacent ring 9. Similarly condensate forming in the steam chamber 6 will spill into any of the plurality of support arms 8 and thence be collected with condensate in the annular ring tubes 9 as earlier described.

With the annular rings 9 providing an increased heating surface area for a given physical size compared with previous arrangements, less resistance to rotation of the beatershaft in the material is presented and thus substantially lower horse power drives may be utilized.

Various equipment would be desirably used in conjunction with the beatershaft 1 for example steam straps and a steam bleed-off for the condensate tube 19 as a reduced or blocked flow of condensate through the tube 19 could result in steam being generated therein and blocking further condensate flow.

Where in the aforegoing description reference has been made to specific components or integers of the invention having known equivalents then such equivalents are herein incorporated as if individually set forth.

Although this invention has been described by way of example and with reference to one particular embodiment thereof it is to be understood that modifications or improvements may be made thereto without departing from the scope of the invention as defined in the appended claims.

I claim:

1. A steam heated beatershaft comprising:

(a) steam inlet means connected with an outer steam chamber, (b) outlet means to remove condensate and air connected with an inner co-axial collecting chamber, (c) a plurality of spaced apart annular hollow rings mounted about and in steam connection with said steam chamber and, (d) means for collecting condensate and air mounted in each ring and providing a flow connection between each ring and said collecting chamber.

2. A steam heated beatershaft as claimed in claim 1 wherein each of said annular rings is steam connected with said steam chamber through a hollow arm.

3. A steam heated beatershaft as claimed in claim 2 in which a respective one of said hollow arms and a further oppositely directed hollow arm both extend radially between each of said annular rings and said steam chamber.

4. A steam heated beatershaft as claimed in claim 2 wherein the arms connected with respective annular rings are angled relative one with the other to facilitate free flow therethrough of said material and to promote agitation of said material thereby.

5. A steam heated beatershaft as claimed in claim 2 wherein said removal means comprises a tube extending between a respective annular ring and said collecting chamber through a respective hollow arm.

6. A steam heated beatershaft as claimed in claim 5 wherein a free end of said tube within said annular ring is inclined in the direction of rotation, in use, of said annular ring.

7. A steam heated beatershaft as claimed in claim 6 wherein said free end is positioned so as to be directed towards an exterior wall of the annular ring and a guide means is positioned so as to guide said condensate and air caused by centrifugal force to be adjacent said exterior wall to pass into said tube through said free end thereof.

8. A steam heated beatershaft as claimed in claim 1 wherein a plurality of blades are each respectively connected between respective sets of said annular rings, each of said blades being angled to thereby control the movement of said material relative to said rings.

9. A steam heated beatershaft as claimed in claim 1 wherein said collecting chamber is tapered so that its wider end thereof is at or adjacent said outlet means.

10. A steam heated beatershaft as claimed in claim 1 wherein said steam inlet means comprises a hollow shaft and said outlet means comprises an outlet tube extending through said hollow shaft and having a free end positioned within said collecting chamber.

11. A steam heated beatershaft comprising:

(a) steam inlet means connected with an outer steam chamber, (b) outlet means to remove condensate and air connected with an inner co-axial collecting chamber, (c) a plurality of spaced apart annular hollow rings, each mounted about and in steam connection with said steam chamber through a respective one of a plurality of hollow arms, (d) condensate and air removal means providing a flow connection between each ring and said collecting chamber, (e) a respective one of said hollow arms and an oppositely directed ring support means both extending radially between each of said annular rings and said steam chamber.

12. A steam heated beatershaft comprising:

(a) steam inlet means connected with an outer steam chamber, (b) outlet means to remove condensate and air connected with an inner co-axial collecting chamber, (c) a plurality of spaced apart annular hollow rings each mounted about and in steam connection with said steam chamber through a respective one of a plurality of hollow arms, (d) condensate and air removal means providing a flow connection between each ring and said collecting chamber, (e) a respective one of said hollow arms and a further oppositely directed hollow arm both extending radially between each of said annular rings and said steam chamber.

13. A steam heated beatershaft comprising:

(a) a steam inlet means connected with an outer steam chamber, (b) outlet means to remove condensate and air connected with an innter co-axial collecting chamber, (c) a plurality of spaced apart annular hollow rings each mounted about and in steam connection with said steam chamber through a respective one of a plurality of hollow arms, (d) a tube extending between a respective annular ring and said collecting chamber through a respective hollow arm to provide a connection there between through which said condensate and said air can flow.

14. A steam heated beatershaft as claimed in claim 13 wherein a free end of said tube within said annular ring is inclined in the direction of rotation, in use, of said annular ring.

15. A steam heated beatershaft as claimed in claim 14 wherein said free end is positioned so as to be directed towards an exterior wall of the annular ring and a guide means is positioned so as to guide said condensate and air caused by centrifugal force to be adjacent said exterior wall to pass into said tube through said free end thereof.

16. A steam heated beatershaft comprising:

(a) steam inlet means connected with a steam chamber, (b) outlet means for removing condensate and air from said beater shaft, (c) a plurality of spaced apart annular hollow rings each mounted about and in steam connection with said steam chamber through a respective one of a plurality of hollow arms, (d) means for collecting condensate and air mounted in each ring and providing a flow connection between each ring and said outlet means, (e) the outer surface of said steam chamber, said hollow arms and said rings defining spaces there between through which material not passing on the outside of said rings can pass.

17. A steam heated beatershaft as claimed in claim 16 wherein a respective one of said hollow arms and an oppositely directed ring support means both extend radially between each of said annular rings and said steam chamber.

* * * * *